US007238872B1

(12) United States Patent
Edwards et al.

(10) Patent No.: US 7,238,872 B1
(45) Date of Patent: Jul. 3, 2007

(54) MUSIC PAGE SCORE TURNER

(76) Inventors: Robert W. Edwards, 1805 Leithsville Rd., Hellertown, PA (US) 18055-1740; Paul C. Stavrou, 3252 Ramblewood La., Slatington, PA (US) 18080

( * ) Notice: Subject to any disclaimer, the term of this patent is extended or adjusted under 35 U.S.C. 154(b) by 152 days.

(21) Appl. No.: 11/212,248

(22) Filed: Aug. 26, 2005

(51) Int. Cl.
*G10G 7/00* (2006.01)

(52) U.S. Cl. ..... 84/486

(58) Field of Classification Search ..... 84/486–519
See application file for complete search history.

(56) References Cited

U.S. PATENT DOCUMENTS

| | | | | |
|---|---|---|---|---|
| 1,605,258 | A | 11/1926 | Meiszner | |
| 1,735,166 | A | 11/1929 | Hossell et al. | |
| 2,705,900 | A | 4/1955 | Iacobitti | |
| 3,064,518 | A | 11/1962 | Chernishenko | |
| 3,939,587 | A | 2/1976 | Westrom | |
| 4,040,195 | A | 8/1977 | Claypool | |
| 4,346,641 | A | 8/1982 | Kobayashi | |
| D269,683 | S | 7/1983 | Barbour | |
| 4,644,675 | A | 2/1987 | Berger et al. | |
| 5,052,266 | A | 10/1991 | Buster | |
| 5,203,248 | A | 4/1993 | Carr et al. | |
| 5,575,097 | A | 11/1996 | Chou et al. | |
| 6,049,033 | A | 4/2000 | Dallas | |
| 6,107,558 | A * | 8/2000 | Cowan | 84/488 |
| 6,215,058 | B1 | 4/2001 | Molchak et al. | |
| 2003/0110925 | A1 | 6/2003 | Sitrick et al. | |

* cited by examiner

*Primary Examiner*—Briggitte R. Hammond
(74) *Attorney, Agent, or Firm*—Charles A. Wilkinson; Clinton H. Wilkinson

(57) ABSTRACT

A mechanical page turner using a removable rack with space page turning bars operated by preloading the rack with pages of a musical score or the like, mounting the rack in the page turning apparatus and then moving the rack by a spiral rod driven by an electric motor from one portion of the apparatus to another.

20 Claims, 11 Drawing Sheets

MUSIC PAGE SCORE TURNER

BACKGROUND OF THE INVENTION

1. Field of the Invention

The present invention is related to devices for turning the pages of books and printed materials, and more particularly is directed to a music book or score page turning device for use by musicians whose hands are otherwise occupied and wherein the pages of the book or score are turned successively when the device is actuated.

2. Preliminary Discussion

The inconvenience of having to turn successive pages of sheet music or a book containing music while engaged in playing an instrument is well-known. Typically, such music book or score is supported either on the instrument itself, such as, in the case of a piano having a built-in music support surface, or alternatively is supported on a separate music stand as is usually the case in an orchestra. The main objection to the use of sheet music is that the musician must periodically, at least for an instant, interrupt his or her performance in order to turn the music score to the next page. This requires the musician to move at least one hand away from the instrument for a moment, which can cause such musician to make a playing mistake, or to lose his or her place, and in general possibly negatively affect the quality of the performance. In some cases, where the musician is trying to turn the page quickly, he or she may inadvertently grab and turn several pages rather than a single page, or may even cause the music book or score to fall from the music stand or support. Some performers, particularly solo performers, will have an assistant nearby who will turn the page for the performer as needed. Such arrangement, however, is visually unattractive at best and can be distracting either to the musician or the audience or both. Most experienced musicians therefore adopt the expedient of reading ahead in their music, essentially memorizing the music and/or lyrics up to the end of a page and then turning the page in time to pick up the piece at the turning point, in the meantime playing the music from memory. This has varying degrees of success for even experienced musicians and frequently leads to mistakes when the musician's memory fails or the musician's attention is distracted by something such as the mistake of another musician. For less experienced musicians, the page turning chore can become a nightmare and almost any musician would be glad to be rid of such chore. Overall, therefore, there is a need for a device that enables performers to turn the pages of a music book or score quickly without interfering with their performance.

3. Description of Related Art

The prior art with respect to page turners evidences that a significant amount of thought and research has accumulated in such technological area over the years, and such thought and research appears to be continuing. However, in the opinion of the present inventor, most of such prior art devices are either error prone, too slow, too bulky and cumbersome, or too noisy to be practical in most uses. Following is a brief review of the most pertinent-appearing art in this area.

U.S. Pat. No. 1,605,258 issued to J. Meiszner on Nov. 2, 1926, entitled "Music Leaf Turner", discloses a page turning device wherein a plurality (preferably ten) of vertical rods extend upwardly behind a book rest, the rods further having arms that extend over the top edge of the book rest, with clips provided on the ends of the arms such clip being successively attached to pages of the book to be turned. Crank arms are attached to the lower end of each rod, which crank arms are connected to a foot control used to rotate the rods one by one to the left to turn successive pages of the book. The Meiszner device therefore uses separate rotating rods to turn each page, rather than using a single sliding rack or member attached to a worm gear as in the present invention.

U.S. Pat. No. 1,735,166 issued to F. Hossell et al. on Nov. 12, 1929, entitled "Page Turning Device", discloses a device wherein a rack mounted above a book rest contains a slide bar on which a plurality of vertical fingers are slidably mounted on collars. Each finger extends downwardly between successive pages of a book, and a foot actuated piston means is used to slide the vertical fingers one-by-one to the left on the slide bar, which action causes the pages to turn. While Hossell et al. teaches the use of sliding rods or fingers to turn pages, the fingers are individually or separately movable and not provided together on a single rack, nor are they moved by a worm gear arrangement as in the present invention.

U.S. Pat. No. 2,705,900 issued to J. Iacobitti on Apr. 12, 1955, entitled "Sheet Music Stand with Page Turner", discloses a music stand having a plurality of arms that extend outwardly from a central vertical support, with each arm having a downwardly extending finger attached thereto, which arms are placed successively between the pages to be turned. A foot activated means is provided for individually rotating each arm about the vertical support, which causes the finger to rotate and press against the page and turn it. Such arrangement is structurally very different from and does not include the advantages of the present invention.

U.S. Pat. No. 3,064,518 issued to P. M. Chernishenko on Nov. 20, 1962, entitled "Devices for Turning Music Pages", discloses a music page turner comprised of a base having a raceway or channel extending substantially along the entire length of the base. A plurality of discs are slidably mounted in such channel, with each disc holding an upwardly extending peg which are inserted between the individual music pages to be turned. An intermediate section of the raceway is circular, where a disc means attached to a shaft and electrically activated by a worm gear is provided. When activated, the worm gear causes the disc means to rotate, which causes the discs to be successively pushed or moved around such circular section, which movement is sufficient to cause the pages directly adjacent each disc to be turned. Such device is rather structurally complicated as compared to the present invention, and is mechanically unlike such invention.

U.S. Pat. No. 3,939,587 issued to J. H. Westrom on Feb. 24, 1976, entitled "Page-Turner for Books and the Like", discloses a page turner wherein each page is turned via a single roller that moves back and forth between the pages of a book or the like. Westrom therefore broadly illustrates a reversible page turner wherein the pages may be turned in either direction, although such arrangement is also completely different from the present Applicant's invention.

U.S. Pat. No. 4,040,195 issued to J. P. Claypool on Aug. 9, 1977, entitled "Page Turner Apparatus", discloses a page turner wherein a book support is mounted on a stand, and wherein a member is slidably mounted on a slide rod extending along the bottom of the support. Such member has teeth extending downwardly from its bottom side, and a slide plate is mounted on its upper side, oriented so that it is generally parallel to the book support. The slide plate includes several vertical and parallel openings in which successive pages of a book or music score to be turned are placed, and a bail is provided to hold the book or music score in place, with the pages to be turned being placed in front or over such bail and extending through the openings in the slide plate. A foot pedal means is engaged with the teeth on the slide member, which causes the slide plate to be pushed or slide just far enough to the left so that the page to be turned and the corresponding opening in the slide plate is moved to the left of the bail, while the next opening is still to the right of bail, so that only a single page is turned. In another embodiment, the slide rod is threaded and the slide plate is mounted on such threaded rod on cooperating threads such that it moves to the left as the threaded rod is turned by an electric motor, which is activated by a foot switch. One drawback characteristic of such device is that the slide plate is evidently permanently attached to the page turning device, which makes it very difficult to quickly and properly place the pages of a music score to be turned in the openings in the slide plate. In addition, the Claypool page turner cannot turn such pages with the speed and precision that is possible by means of the present invention.

U.S. Pat. No. 4,346,641 issued to I. Kobayashi on Aug. 31, 1982, entitled "Apparatus for Automatically Turning the Pages of a Music Box", discloses a music stand having a rotatable gear attached along the upper center portion of the stand, and further having a plurality of slats attached to such gear which extend between successive pages of a music score. A series of slits are provided in the gear, which come into contact with ends of the slats, causing them to turn, which causes the pages of the music score to also be turned. Such arrangement is also substantially unlike the page turning device of the present invention.

U.S. Pat. No. 4,644,675 issued to J. G. Berger et al. on Feb. 24, 1987, entitled "Page Turning Device", discloses another page turning device wherein a motor driven rotatable gear is situated adjacent the upper center portion of a music stand, and situated on the gear is a rotating disc having finger portions that extend between successive pages of a book to turn the pages. Such pages must first, however, be curled slightly by a roller so that the finger portions can slip or extend between the pages.

U.S. Pat. No. 5,052,266 issued to R. C. Burster on Oct. 1, 1991, entitled "Page Turner for Music Manuscripts and the Like", discloses a music page turner wherein a rotatable shaft is mounted behind a music support stand, and wire page turner elements are connected to such shaft that engage the upper corners of each page to be turned. A sequential release mechanism is provided to individually turn such pages as the shaft is rotated. Such arrangement is also completely unlike the present inventor's page turner.

U.S. Pat. No. 5,203,248 issued to D. J. Carr et al. on Apr. 20, 1993, entitled "Portable Page Turner for Music Sheets", discloses a battery operated, reversible motor driven page turner wherein several 'torpedo tabs' having clips which are attached to successive music pages to be turned are secured to a belt drive. Various gates are sequentially opened and closed to allow the torpedo tabs to move individually to the left on the belt. Although Carr et al. teaches a battery operated and reversible page turner, such pages are turned by movement of the individual tabs, rather than by movement of a single slide plate on a worm-type gear as in the present invention.

U.S. Pat. No. 5,575,097 issued to J. P. Chou et al. on Nov. 19, 1996, entitled "Page Turning Device", discloses a battery operated, reversible motorized page turner apparatus wherein ferrous tabs are secured to the edges of each page of sheet music, and then a motorized arm having a magnetic tab on its end is used to sequentially grab each page and turn it whenever desired.

U.S. Pat. No. 6,049,033 issued to W. G. Dallas on Apr. 11, 2000, entitled "Page Turning Device", discloses another motorized page turner having a spring arm with a finger element on its end that is used for gripping and sequentially turning each successive page.

U.S. Pat. No. 6,215,058 issued to P. R. Molchak et al. on Apr. 10, 2001, entitled "Remote Controlled Page Turner Utilizing a Plurality of Movable Fingers", discloses another motor driven, battery operated page turner wherein rods extending upwardly from a case located beneath the book are placed between each page to be turned, and then the individual pages are turned by moving or rotating each rod around a central shaft. Molchak et al. therefore does not utilize a slide plate arrangement as in the present invention.

U.S. PAT. APPLN. PUB. 2003/0110925 filed by D. H. Sitrick et al. and published on Jun. 19, 2003, entitled "Electronic Image Visualization System and Communications Methodologies", discloses a completely digital or electronic music stand system wherein music pages are stored in digital format and displayed on a computer screen. Several stands may receive the same information from a central computer system so that an entire orchestra can view the displays.

U.S. DES. Pat. No. 269,683 issued to B. E. Barbour on Jul. 12, 1983, entitled "Electric Sheet Music Page Turner", discloses an ornamental embodiment for a music sheet page turner wherein arms that attach to the pages to be turned by clips are rotatable about a central axis.

Of the prior art page turning devices known to the present inventor, only the Claypool '195 device utilizes a sliding plate to move or turn the individual pages or sheets. In the second embodiment of the Claypool '195 invention, described with reference to FIGS. 4 and 5, the sliding plate is mounted on a threaded rod such that when the rod is rotated via a motor actuated by a foot pedal, the sliding plate moves transversely until a single page is turned. Claypool, however, does not appear to have considered carefully the importance of the amount of time it takes to turn each page. If the page is turned too slowly, the effectiveness of the device is considerably reduced because, for example, a musician who is used to reading and playing at a relatively constant speed or pace may be caused to lose his or her place during a performance. On the other hand, if the Claypool turning device turns the pages too quickly, the device will essentially be uncontrollable, since Claypool does not include a means for indicating when the slide plate has moved the desired distance to turn a single page. Claypool also does not teach any means for calibrating or adjusting the movements of the page turner, and therefore it is prone to error. In addition, while the Claypool slide plate as disclosed is permanently connected to the page turning device, the present inventor's page turning racks are easily detached and reattached to the page turner, so that a book or music score can be pre-loaded in the rack and then placed in the mount and connected with the mechanism, thereby making the present inventor's racks significantly easier to load than the Claypool plate. As a result, the present inventor can pre-load several racks, if necessary, and then easily attach the racks sequentially to the page turning device as needed, so that if a music score is too long to fit in a single rack, or if more than one composition is going to be performed following music in separate books or the like, after the first composition has ended, the rack holding such music can be simply removed from the page turning device and replaced with another pre-loaded rack holding the new composition. In addition, the present inventor's page turning device also includes an adjustable binder or music book support, so that the support can be adjusted for use with books or music scores having different thicknesses and widths. Preferably, also the individual arms of the rack can be disconnected at one side of the rack and during loading of the rack laid between the proper pages. This obviates the necessity to thread the pages individually between the arms of the rack.

OBJECTS OF THE INVENTION

It is therefore a primary object of the invention to provide a device for automatically turning one or more pages of a book or music score supported on a stand or instrument quickly, simply, and with as few distractions to the user as possible.

It is a further object of the invention to provide a device for turning the pages of a music score one by one automatically and in consecutive order, such device being operated by a foot pedal, thereby leaving the user's hands unburdened by such task and therefore free to continue the musical performance.

It is a still further object of the invention to provide a music sheet turning device having a reversible DC motor to enable such pages to be turned in either a forward or reverse direction.

It is a still further object of the invention to provide a music page turning device that is powered by a battery-operated motor controlled or actuated by a foot pedal.

It is a still further object of the invention to provide a music page turning device for turning successive pages of a book of music wherein the dimensions of the book rest or support portion of the device can be adjusted to accommodate books having different widths or thicknesses.

It is a still further object of the invention to provide a music page turning device having a page turning rack that is arranged to slide transversely on said device a distance sufficient to turn a single page of a music book or score, and which rack is detachable from the device to enable the pages of a music book or score to be more easily and quickly loaded into the rack, or for several racks to be used interchangeably with the page turning device as desired.

It is a still further object of the invention to provide a page turning device wherein said device is capable of more quickly and accurately turning the pages of a music book or score to the next page in succession than is possible in previous known page turning devices.

It is a still further object of the invention to provide a page turning device in which the speed of movement of the turning device is adjustable and can be preset or calibrated as to rigidity of operation upon the activation of a switch by the musician and once initiated will operate at the most desirable speed and stop automatically at the correct point.

Still other objects and advantages of the invention will become clear upon review of the following detailed description in conjunction with the appended drawings.

SUMMARY OF THE INVENTION

The invention provides a page turner particularly for books, musical scores, and the like which makes use of a unitary movable and releasable rack the bars of which extend between the pages of a musical score. The page turner can be calibrated and adjusted to move the rack at varying speeds relative to a particular executed speed of playing and which once movement is initiated in it by the musician will continue until a page has been turned and then will stop automatically until further initiated by the musician, with movement being initiated and continued at a preset rate. The invention also preferably includes an adjustable support that enables the device to accommodate and operate successfully and efficiently with music books and scores of varying thicknesses. The invention may also be conveniently used with two or more pre-loaded page turning racks wherein each is connected to the rack when such music is ready to be played, with the previous rack being easily removed.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The available prior art demonstrates a considerable activity in the past in developing music and other page turners, yet none, so far as the present inventor is aware, has met with any great success, due apparently to lack of versatility as well as difficulty in using. After considerable study of the problem, the present inventor has developed, as described below, an improved automatic page turner obviating many, if not most, of the problems which have been encountered with prior page turners. In particular, the page turner of the present invention requires little thought on the part of the user to operate reliably other than merely clicking on or pressing of a switch. Such switch does not have to be continually held down, but need merely be activated, after which the page turner will proceed automatically through its regular or present routine following an accelerated movement during the majority of its operation, but beginning and ending such movement at an accelerating and decelerating speed above and beyond that attainable with merely an on and off switch. The page turner of the invention also allows multiple racks to be preloaded with pages of various music or other books and to be used consecutively during a single or even multiple playing sequences. The new page turner also provides for an adjustable printed material rest to support the bottom and rear or back of the work being turned, no matter how thick the multipaged work, at least within the scope of the majority of musical scores. The use of substantially round or at least curvilinear rungs in the movable rack of the page turner of the invention also contributes to its efficiency and usefulness.

Reference will now be made in detail to a presently preferred embodiment of the invention as illustrated in the accompanying drawings. Whenever possible, the same reference numbers will be used throughout the drawings to refer to the same or like parts.

Figure 1:
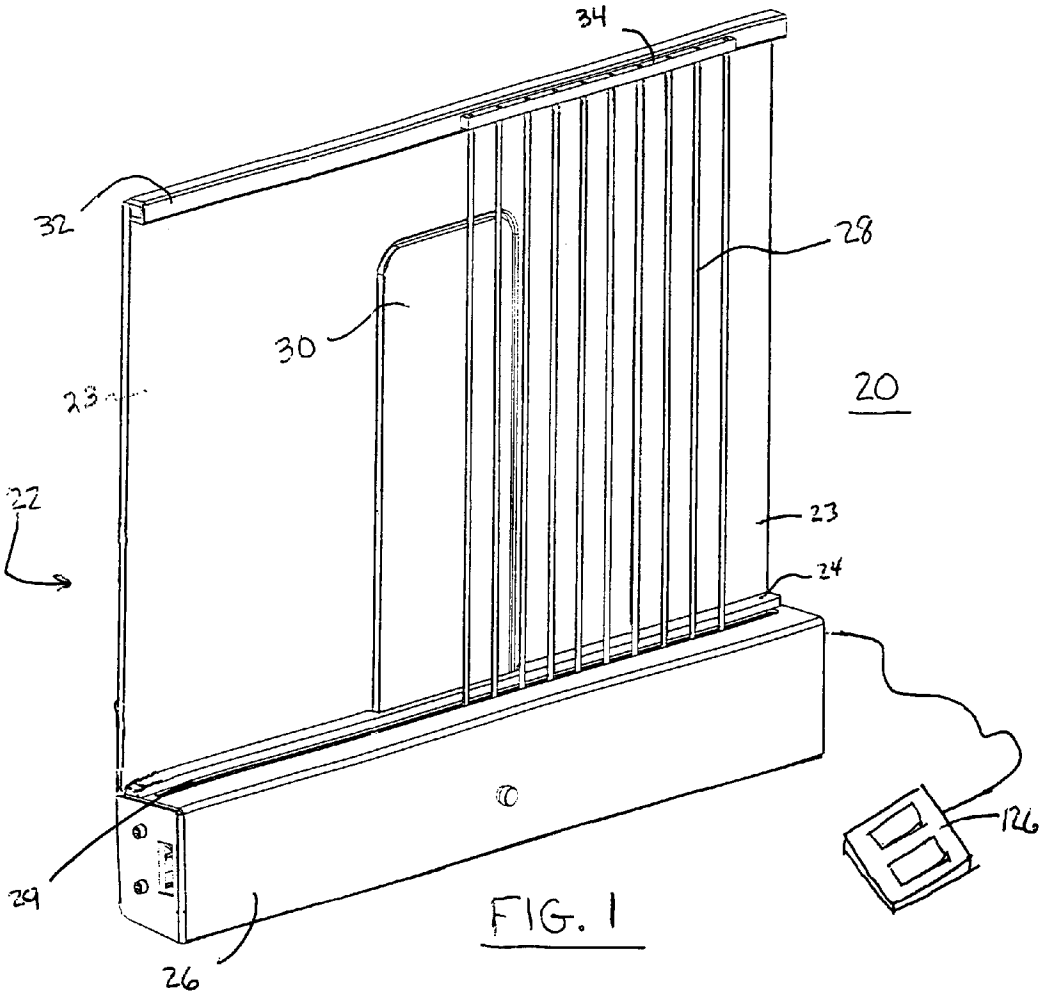
FIG. 1 is a perspective view from the left front of a preferred embodiment of the music score page turning device of the present invention.
Figure 2:
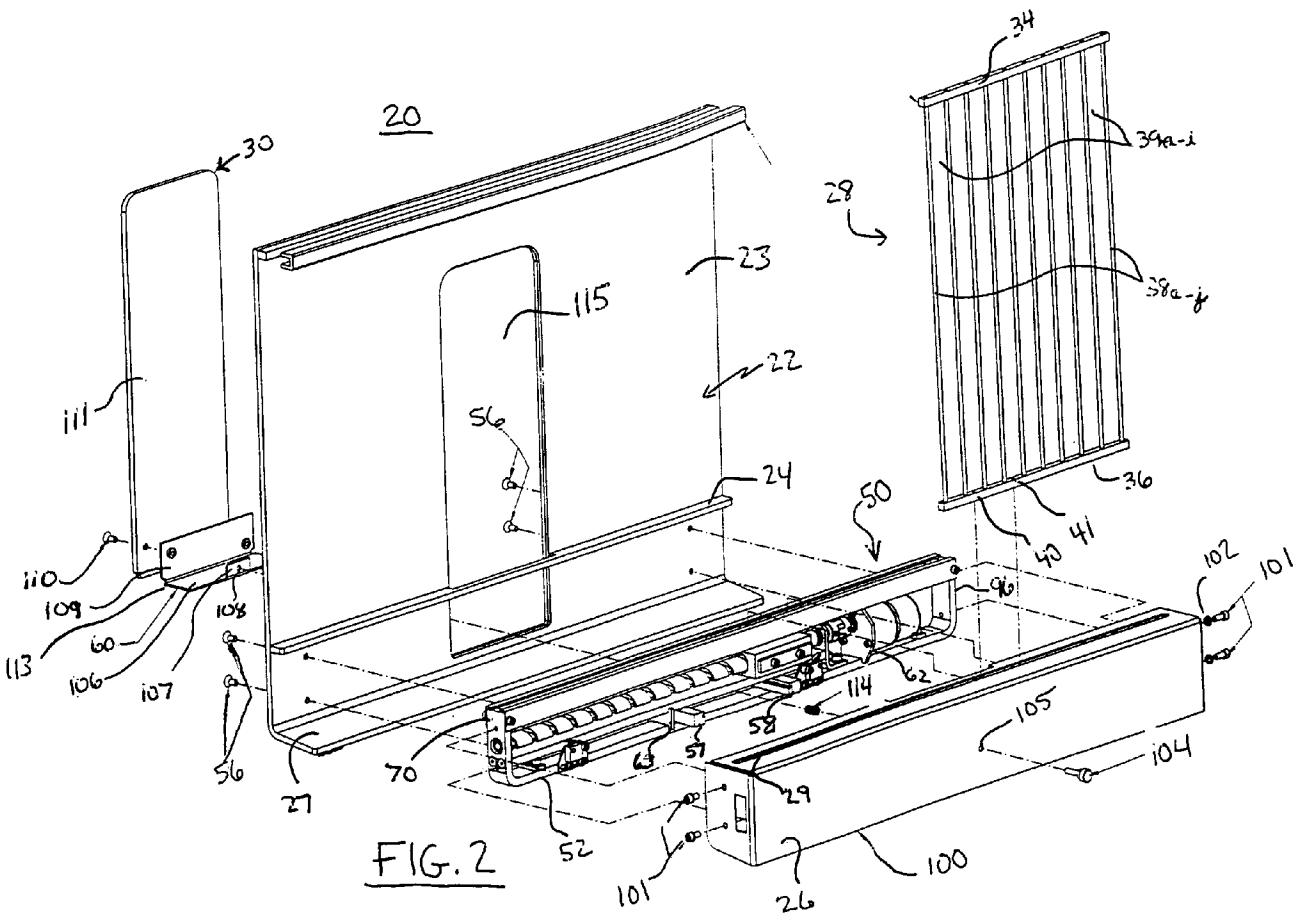
FIG. 2 is an exploded view of the music score page turning device shown in FIG. 1.
Figure 13:
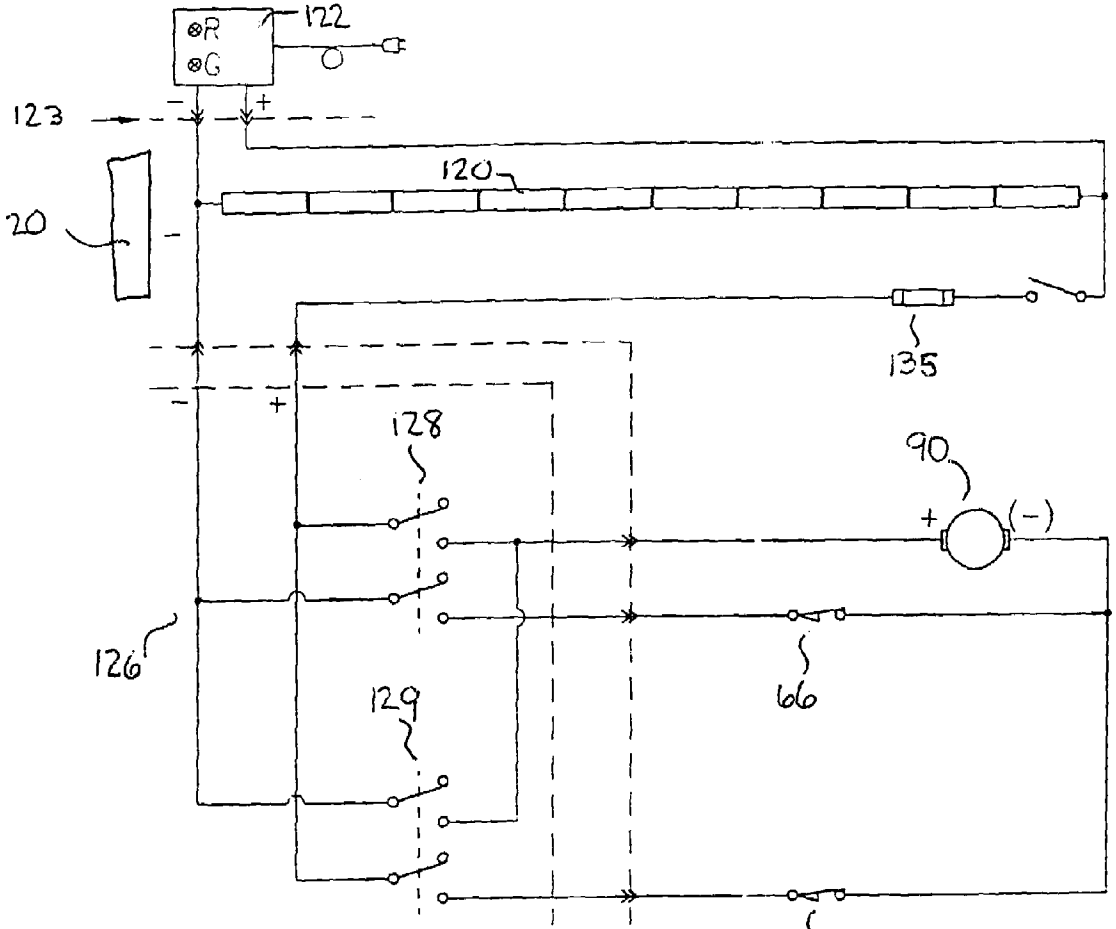
FIG. 13 is an electrical wiring diagram for the preferred embodiment of the invention shown and described with reference to FIGS. 1-13.
Figure 14:
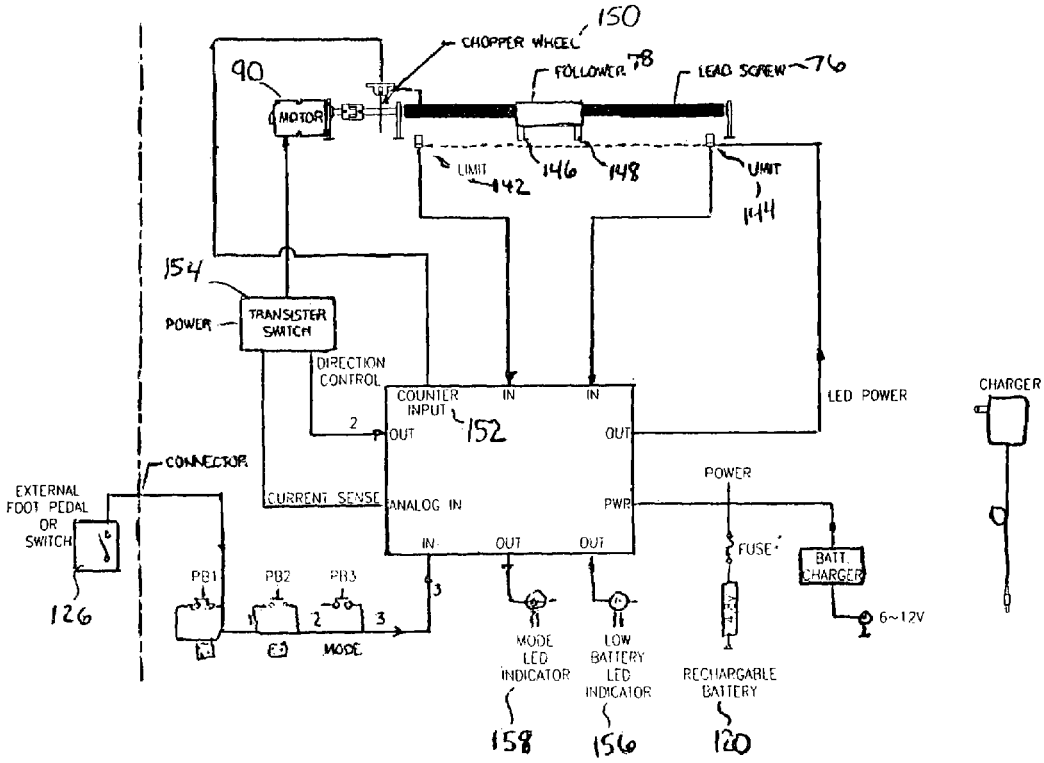
FIG. 14 is an electrical wiring diagram of another preferred embodiment of the invention.
Figure 15:
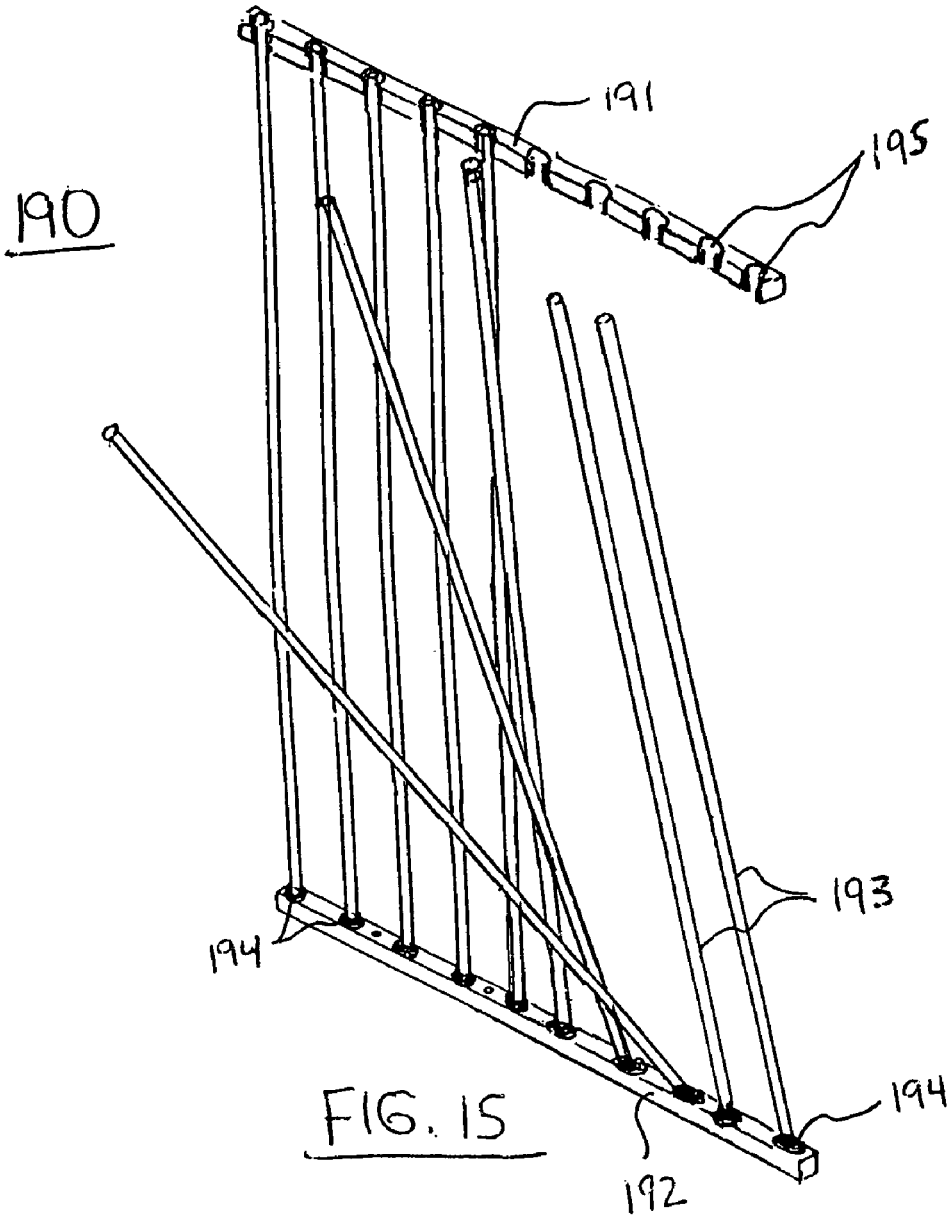
FIG. 15 is a view of a preferred page rack having pivoted arms on the rack allowing such arms to be pivoted down out of the way and then pivoted up again between pages as the pages are turned preparatory to mounting the loaded rack and score into the page turner.

FIGS. 1-13 illustrate a first preferred embodiment of the invention, while FIG. 14 illustrates the electrical control system of a second preferred embodiment, and FIG. 15 illustrates an alternative rack arrangement. Referring first to FIGS. 1 and 2, the automatic music score page turning device in accordance with the teachings of the invention is indicated generally by reference numeral 20, and is comprised generally of platform 22 for supporting a book or music score, a base 26 also serving as a housing, at least one page turning rack 28, and a laterally adjustable book support device 30. Also shown in FIG. 1 is foot control 126 which is used for operating device 20. Book or music score support or platform 22, as best shown in FIG. 2, is preferably made of sheet metal and includes a flat, generally rectangular and vertically extending back support section 23 with a substantial ledge 24 connected to or adjacent thereto projecting forwardly at approximately a right angle to back support section 23. With such arrangement of platform 22, the bottom edge of a music book or score placed or resting thereon will be principally supported on ledge 24, while the rear side of the book or score rests against back support section 23. Housing, or base, 26 is secured to the front side of platform 22 just below ledge 24, and, as is discussed in detail below, encloses the motor and most of the electronic controls for operating the automatic page turning device 20. As is also discussed in further detail below, page turning rack 28 (see FIG. 2) is connected to page turning device 20 as shown in FIG. 1 so that it extends upwardly through slot 29 on the top side of housing 26 and is aligned in parallel with the front surface of back support section 23. Attached to the front top edge of back support section 23 extending out slightly from back support section 23 is spacer 32 against which the top inner edge of upper rail 34 of rack 28 slideably rests. Laterally adjustable book support device 30, the details of which are also discussed further below, allows device 20 to be operably adjusted to accommodate books or music scores of varying thicknesses. If only standard music score collections or books are to be used the adjustable book support may not be necessary.

Page turning rack 28, as is best illustrated in the exploded view of device 20 in FIG. 2, is comprised of upper and lower rails 34 and 36 which are secured to opposite ends of a plurality of rod or rib members 38*a-j* arranged in parallel and preferably equally spaced-apart, and forming openings or slots 39*a-i* between such rods. Rails 34 and 36 and rods 38*a-j* may be made from light wood, metal, plastic and possibly other materials having the appropriate and advantageous physical characteristics and properties. Rods 38*a-j* should be long enough so that the openings or slots 39*a-i* formed between such rods can receive or accommodate the individual pages of a typical music score or book to be turned using device 20. In a preferred but merely exemplary embodiment, rails 34 and 36 each have a length of approximately 8.25 inches and a width and thickness of approximately 0.25 inches, and rods 38*a-j* are secured in matching apertures in rails 34 and 36 spaced equally 0.875 inches apart along the length of such rails 34 and 36. Rack 28 preferably includes ten (10) rods, which number it has been found will accommodate an average length music score usually being no more than approximately twenty (20) pages in length, although rack 28 and device 20 may of course be adapted to include a greater or lesser number of rods as may be desired, and further may have different dimensions and may accommodate one or more alternative modes of construction without deviating from the scope and nature of the invention. Page turning rack 28 connects to device 20 so that successive pages of a music score loaded in such rack are turned quickly and easily when the rack is moved laterally in either a forward or reverse direction a predetermined distance. Apertures 40 and 41 are additionally provided in the bottom surface of lower rail 36, and, as is shown and explained below, are used to detachably secure page turning rack 28 to device 20.

Figure 3:
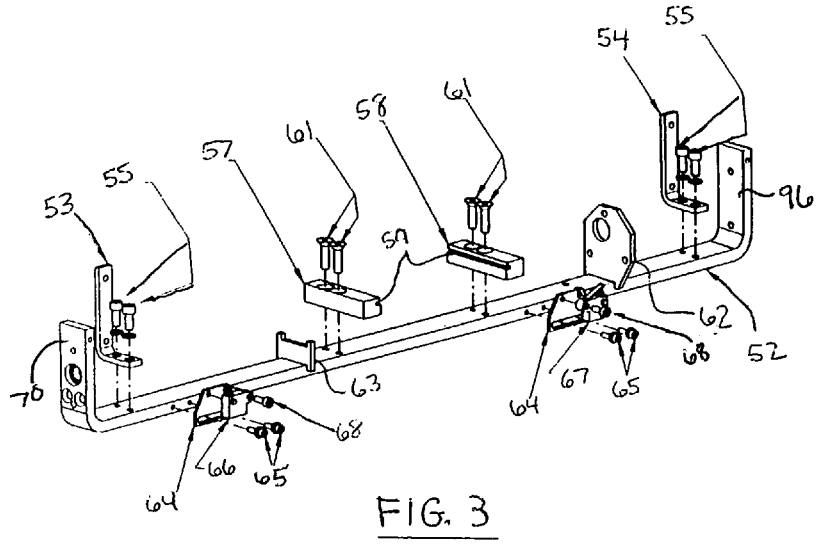
FIG. 3 is an exploded view of the components of the page turning device that are mounted directly to the C-shaped mounting frame that comprises part of the control system of the invention.

As indicated above, housing 26, which is preferably made of sheet metal, serves as an enclosure for most of the major elements of the control mechanism 50 used for operating device 20. The exploded views in FIGS. 3-6 are provided to further illustrate such mechanism 50, and are referred to generally in succession below. Referring first to FIG. 2, metal C-shaped mounting frame 52 (shown in further detail in FIG. 3) is secured to the back support portion 23 of music score platform 22 at a location below ledge 24, so that it is entirely contained in housing 26. More particularly, screws 56 extend through apertures in back support portion 23 into L-shaped rear support blocks 53 and 54, which, as shown in FIG. 3, are preferably secured to the main section of frame 52 near its ends by screws 55, although blocks 53 and 54 may also be permanently welded frame 52. Spaced apart guides or blocks 57 and 58 having inwardly facing and aligned channels 59, in which the edges of guide member 60 of adjustable book support device 30 are slidably secured (see also FIG. 2), are connected to C-shaped mounting frame 52 by screws 61 at a position generally adjacent the center section of such frame. Also secured to mounting frame 52 is motor support 62 and anti-rotation block support 63, the purposes of which are explained below, while forward and rearward limit switch supports 64 are secured at appropriate positions along the front edge of frame 52 by screws 65, see FIG. 3, and forward and reverse limit switches 66 and 67 are secured to supports 63 and 64 by screws 68, respectively.

Figure 4:
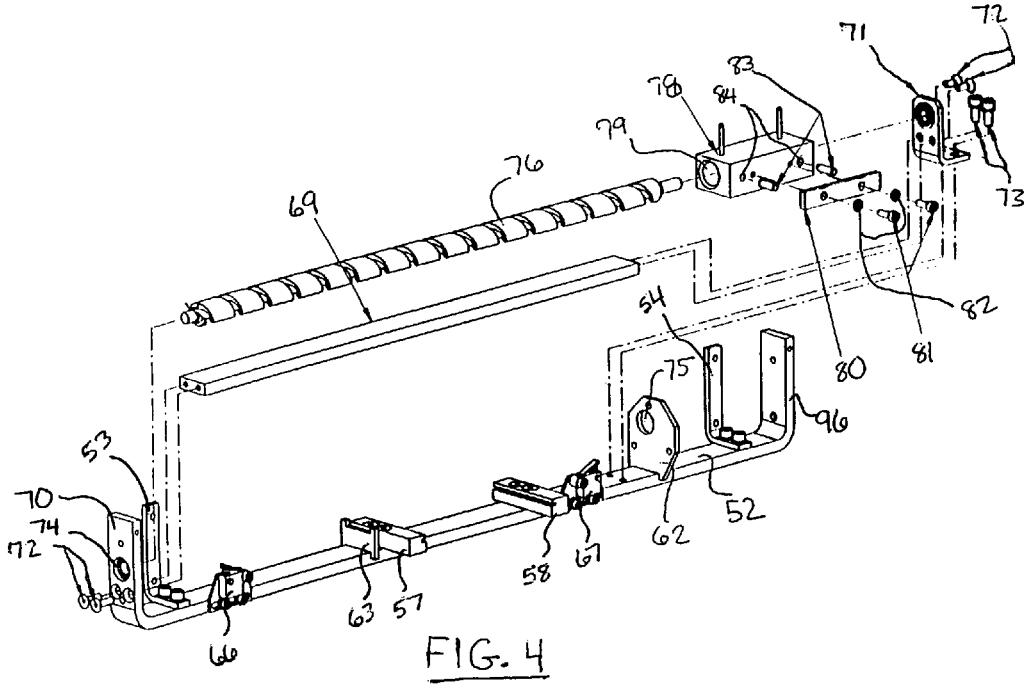
FIG. 4 is an exploded view of the C-shaped mounting frame shown in FIG. 3 with the parts shown in FIG. 3 mounted to said frame and with the further parts to be mounted to said parts shown in exploded view.

Referring now to FIG. 4, anti-rotation block 69 is connected on one end to first arm 70 of C-shaped mounting frame 52, and on its other end to rod support 71, by screws 72, while rod support 71 is mounted directly to frame 52 by screws 73. The center section of anti-rotation block 69 is resting or supported on anti-rotation block support 63. In addition, rotatably secured on one end in flanged bearing 74 on first arm 70 of C-frame 52, above anti-rotation block 69, and on its other end in flanged bearing 75 in rod support 62, is threaded rod or screw 76. Next, translating block 78 having a bore 79 extending longitudinally therethrough for receiving rod or screw 76 is provided. Bore 79 contains threads that cooperate with those threads on rod or screw 76 such that block 78 is laterally movably supported on rod 76 via such threads. Pin capture plate 80 is connected to the front side of translating block 78 by screws 81 with washers 82, while pins 83 are inserted in through-apertures 84 in said same front side of translating block 78.

Figure 5:
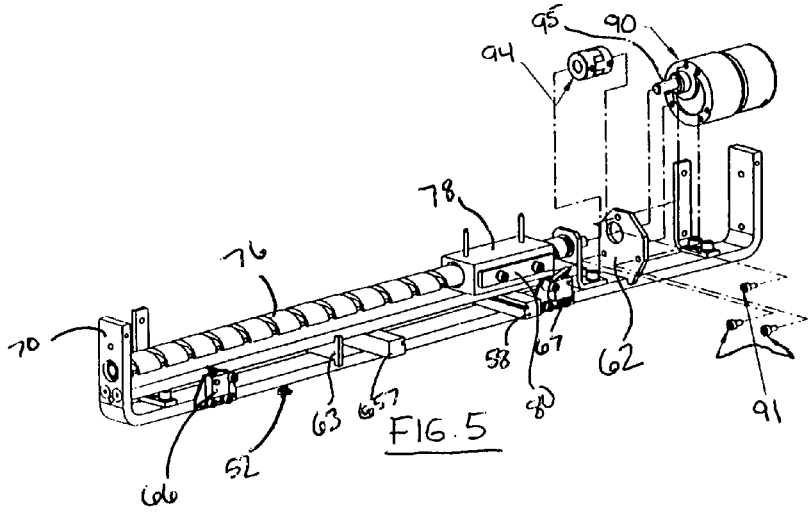
FIG. 5 is an exploded view of C-shaped mounting frame shown in FIGS. 3 and 4 with the parts shown in FIGS. 3 and 4 mounted to said frame, and with the DC motor and arrangement shown in exploded relationship.
Figure 6:
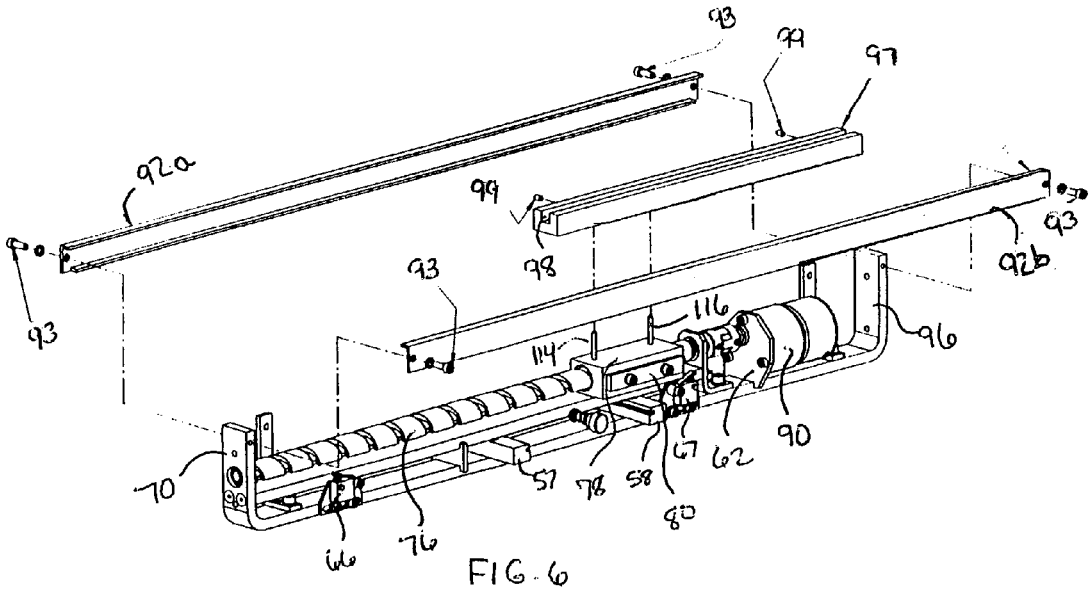
FIG. 6 is an exploded view of C-shaped mounting frame shown in FIGS. 3-5 with the parts shown in FIGS. 3-5 mounted to said frame, and with guide rails and rack support shown ready to be mounted therewith in exploded view.

FIG. 5 generally illustrates the arrangement of reversible DC motor 90 on C-shaped mounting frame 70, which motor 90 is secured to motor support 62 by screws 91. Jaw-type or interlocking coupling 94 connects armature shaft 95 of motor 90 to the end of threaded rod 76, so that when motor 90 is energized and shaft 95 is rotated, rod 76 will rotate in the same direction and at the same speed as shaft 95. In FIG. 6, the arrangement of guide rails 92*a* and 92*b* is shown, with such rails being secured on one end to the sides of the upper ends of first arm 70, and on the other end to the sides of second arm 96 of C-frame 52, by screws 93. In addition, rack support 97 having an upwardly facing rack receiving channel or groove 98 on its top surface is secured between such guide rails 92 and 93 so that it is slidable between flanges of such rail. A pair of apertures (not shown) are provided in the rear side surface of rack support 97, in which ball nose spring plungers 99 are inserted and secured. Two apertures (also not shown) are also provided in the bottom surface of rack support 97 extending through such bottom surface into the bottom of rack receiving channel 98, which apertures are adapted to receive dowel pins 114 and 116 attached extending upwardly from the top surface of translating block 78. As a result, rack support 97 is secured both in the rail formed by rail members 92*a* and 92*b*, and on dowel pins 114 and 116 connected to translating block 78, such that rack support 97 can only move laterally along such rail when translating block 78 is moved on threaded screw 76 when such screw is turned or rotated by motor 90.

Referring once again to FIG. 2, after the mechanism 50 of the invention has been assembled as just described with particular reference to FIGS. 3-6, and as indicated above, first and second arms 70 and 96 of C-shaped mounting frame 52 are secured by screws 56 to book or music score platform 22 below ledge 24 and above bottom member 27, that extend through matching threaded apertures in book platform 22 and rear support blocks 53 and 54, respectively (which are visible in FIG. 3). Cover 100 of housing 26, which is formed by the combination or joining of bottom member 27 and cover 100, is then secured over mechanism 50 by screws 101 with washers 102 which are passed though apertures in the sides of cover 100 into matching threaded apertures in the outer surfaces of first arm 70 and second arm 96 of C-shaped mounting frame 52, respectively. At the same time, adjustable book support 30 must also be connected to device 20. Support 30 is comprised of an L-shaped guide member 60 having a first flange section 106, an upwardly extending plate 107 having a threaded aperture 108 therein situated on the forward end of first flange section 106, and a second flange section 109 which is secured by bolts or screws 110 to vertical adjustable binder support top 111. The side edges 113 of first flange section 106 are slidably engaged in channels 59 in binder support guides 57 and 58, see FIG. 3, while thumb screw 104 is passed through aperture 105 in the front of cover 100 and threadably connected in threaded aperture 108 in upwardly extending plate 107 of binder support section 60, with compression spring 109 secured over thumb screw 104, see FIG. 2. Binder support top 111 is now movable in aperture 115 of back support section 23 of book support 22 within a certain range to adjust for the thickness or number of sheets of a particular music score. Finally, page turning rack 28 is attached to rack support 97. This is accomplished by inserting the lower rail 36 of rack 28 through slot 29 in the top of cover 100 of housing 26 into rack receiving channel 98 of rack support, with the upper ends of dowel pins 114 and 116, which extend upwardly from translating block 78 through apertures in the bottom of channel 98, being passed into matching apertures 40 and 41 in lower rail 36.

Figure 7:
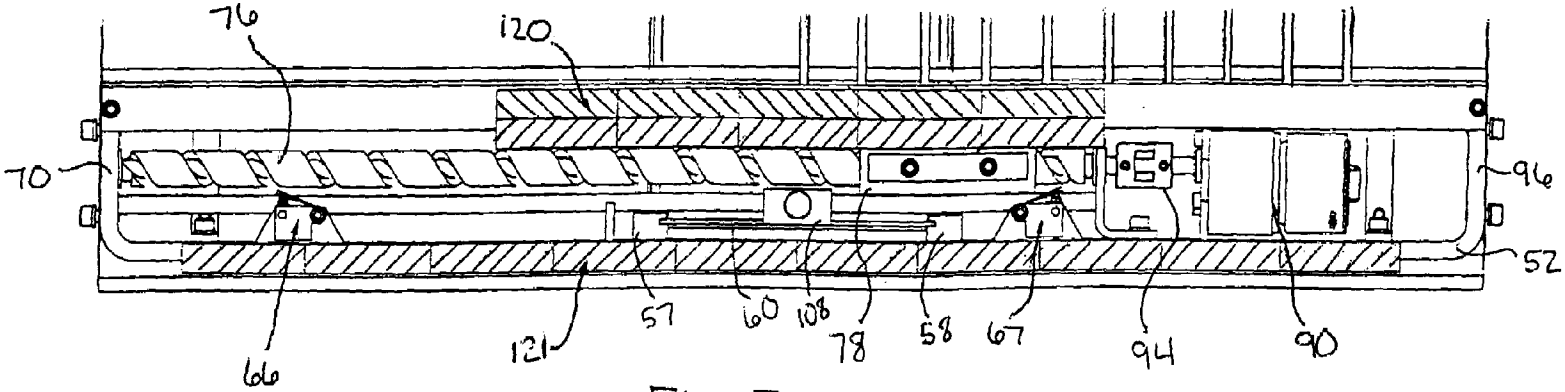
FIG. 7 is a front view of the assembled control system housing portion of the invention with the housing cover removed.
Figure 9:
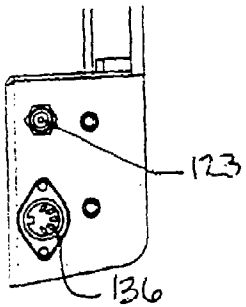
FIG. 9 is right side view of the invention as shown in FIGS. 7 & 8.
Figure 8:
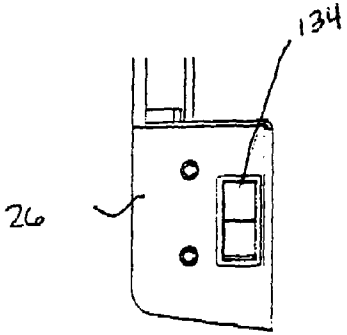
FIG. 8 is left side view of the invention as shown in FIG. 7.
Figure 10:
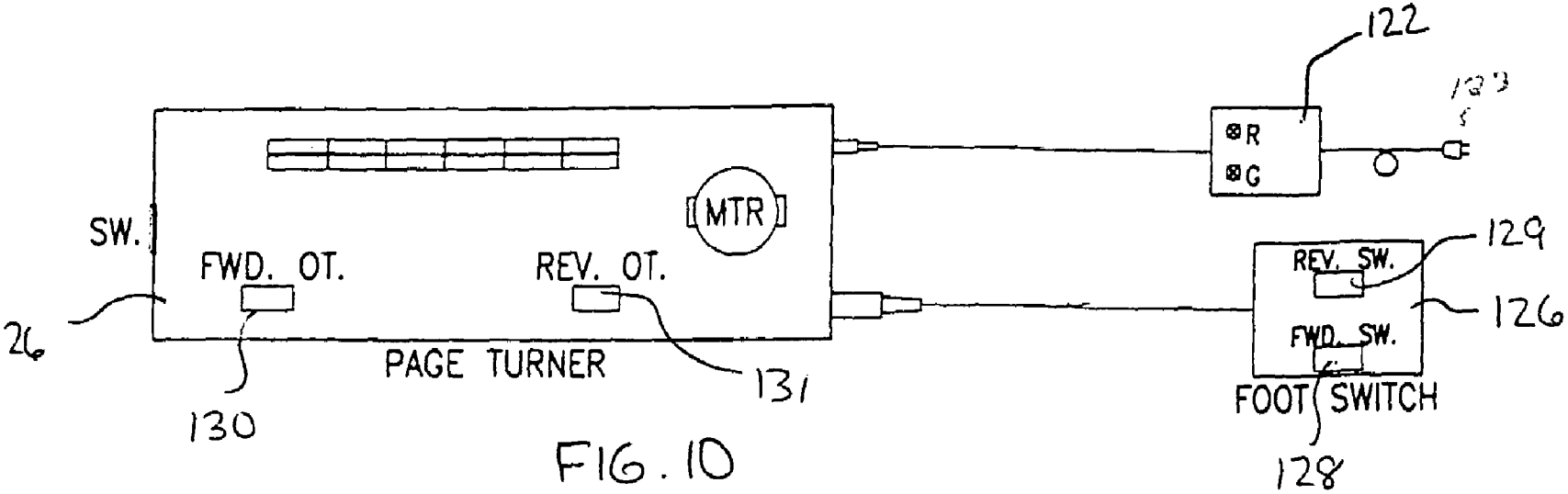
FIG. 10 illustrates the page turner device control housing, rechargeable battery charger, and foot pedal or switch for operating the device.

Reversible DC motor 90 is preferably powered, as shown in FIGS. 7-10, by a rechargeable battery pack, shown alternatively positioned in FIG. 7 in housing 20 by reference numerals 120 and 121, operably connected to charger 122 through DC power jack 123 (see FIG. 10). Motor 90 is then preferably also operably connected to a foot control or switch 126 (see again FIG. 10), which switch preferably includes a forward switch 128 arranged to cause motor 90 to turn motor shaft 95 and rod 76 in a direction which causes translating block 78, and as a result also rack support 97 and rack 28, to move to the left a distance sufficient to cause a single page of a book or music score arranged in rack 28 (as is described in detail below) to be turned to the next page in a forward direction. Foot pedal 112 preferably also includes a reverse foot switch 129 operably connected so as to cause motor 90 to turn motor shaft 95 and rod 76 in the opposite direction, and as a result causing translating block 78, rack support 97, and rack 28 to move to the right a sufficient distance so that a single page of such book or music score arranged in rack 28 is turned back or in a reverse direction. As has already been discussed above and is further illustrated in FIG. 7, forward and reverse limit switches 66 and 67 are spaced apart so that when threaded rod or screw 76 is turned beyond a certain number of rotations in either a forward or reverse direction, and translating block 78 and page turning rack 28 are as a result moved along rod 76 a certain predetermined maximum distance, either of the switches 66 and 67 are activated by pin capture plate connected to the forward side of translating block 78, which activation causes a break in the electrical circuit of such device, thereby preventing further movement of the page turner device in such direction. Forward and reverse movement travel lights or indicators 130 and 131, respectively, shown on the front surface of housing 26 in FIG. 10, may also be provided in a clearly visible position. Also preferably provided are an on/off rocker power switch 134 (FIG. 8), as well as 5-pin CIP DIN connector 136 (FIG. 9).

Figure 11:
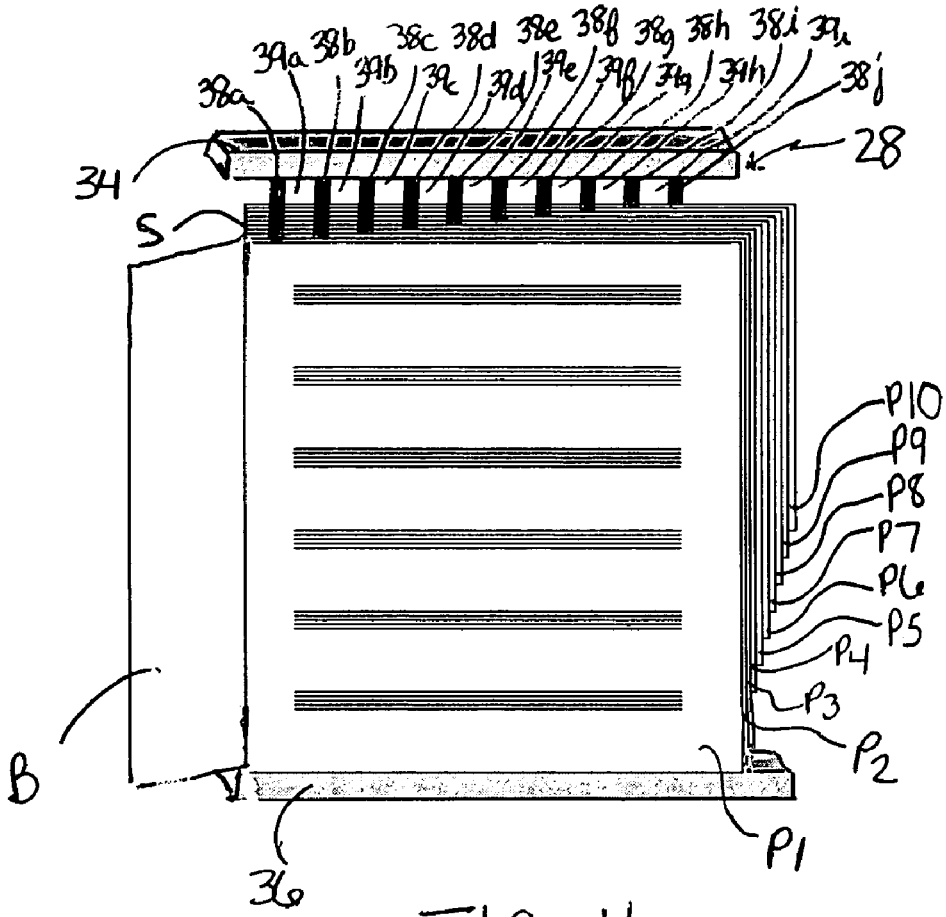
FIG. 11 illustrates the manner in which pages of a book or music score are loaded into the page turning rack of the invention.

To use the page turning device 20 of the invention, first, the individual pages of a book or music score must be loaded or placed in rack 28. An example of how this may typically be accomplished is shown in FIG. 11, wherein the pages of book B to be turned are inserted in rack 28, which is comprised of upper and lower rails 34 and 36 and a number of equally spaced apart vertical parallel rods 38*a-j* extending between rails 34 and 36 such that slots 39*a-i* being formed between such rods. Rods 38*a-j* preferably have a smooth, rounded surface so that the pages inserted in slots 39*a-i* do not become inadvertently caught or snagged on the rods, which might interfere with the page turning operation. In FIG. 11, book B is placed behind rack 28, and then the first page to be turned p1 is placed around the front of rod 38*a*, from the left, and is oriented so that rod 38*a* is positioned near the spine S of book B. The next page to be turned, p2, is then inserted through slot 39*a* formed between rods 38*a* and 38*b*. The next page to be turned p3 is inserted in slot 39*b* formed between 38*b* and 38*c*, page p4 is inserted through slot 39*c* between rods 38*c* and 38*d*, page p5 is inserted in slot 39*d* between rods 38*d* and 38*e*, page p6 is inserted in slot 39*e* between rods 38*e* and 38*f*, page p7 is inserted in slot 39*f* between rods 38*f* and 38*g*, page p8 is inserted in slot 39*g* between rods 38*g* and 38*h*, page p9 is inserted in slot 39*h* between rods 38*h* and 38*i*, and page p10 is inserted in slot 39*i* between rods 38*i* and 38*j*. Once all of the pages have been inserted as just described, as shown in FIG. 11, pages p1-p10 now lie essentially flat and adjacent one another, except with the rods being positioned between such pages. Of course, device 20 and page turning rack 28 may be arranged to operate with a greater or lesser number of rods 38 so as to either increase or decrease the number of slots 39 available for pages to be loaded into rack 28 and eventually turned by the device. If the user wishes to skip a page, two pages may be inserted in the same slot so that they are turned together, although this is usually thought not to be necessary with respect to music score pages or booklets.

Figure 12:
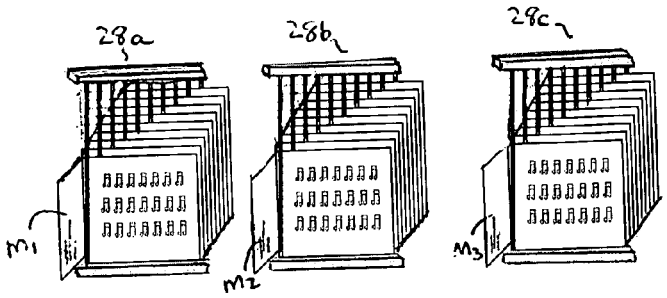
FIG. 12 illustrates the provision of several page turning racks that are pre-loaded with books or music scores to be used with the page turning device of the invention.

A particularly useful feature of the present inventor's page turning device is that a musician can easily preload several separate page turning racks 28, such as those shown in FIG. 12 by racks 28*a*, 28*b*, and 28*c*, prior to a performance, recital, or the like, and then use them consecutively, or one after the other, with page turning device 20. For example, rack 28*a* may be pre-loaded with the first music score M1 to be performed, and would be connected to device 20 on rack support 97. After such music has been played or performed, rack 28*a* may be removed from rack support 97, and then a second rack 28*b* can be attached to support 97. Then, once the music score M2 on the second rack 28*b* has been played or performed, it may be removed and rack 28*c* containing music score M3 may be attached to rack support 97. As a result of the design of device 20, the racks are connected to such device simply by aligning apertures 40 and 41 in rail 36 with dowel pins 114 and 116 protruding upwardly through channel 98 in rack support 97 from translating block 78, and inserting such dowel pins in the apertures. The racks 28*a-c* may be removed from rack support 97 simply by grasping such rack and pulling it upwardly until dowels 114 and 116 are no longer in apertures 40 and 41. Thus, individual attachment and removal of racks 28*a-c* to and from device 20 can be accomplished quickly and simply. As will be recognized from the drawings and as has already been discussed, the pins 114 and 116 extend through the bottom of the rack support 97 maintaining it in place on the translating block 78, and extend into the rack receiving groove 98 on the upper surface of rack support 97 where they can engage with coordinated orifices on each one of a pair of orifices on the bottom of the racks 28. Other arrangements for detachably securing the rack to the rack support and the page turning device of the invention may also be provided.

The ability to remove and then re-attach the racks 28 as just described has the significant advantage that it enables such racks to be loaded while they are detached from rack support 97. This makes such loading task much easier than if the racks were permanently connected to device 20, as they can be laid on a flat surface such as a table or in another position that is comfortable to the user, and the music score pages loaded into the rack as described above, without the structural parts of page turning device 20 getting in the way or otherwise interfering with such procedure. In addition, the racks can be preloaded at a different site and brought to the site where the page turning device is kept, or alternatively the same rack could be used with different page turning devices of the invention.

Once the pages p1-p10 of a music book B have been loaded into a rack 28, and the rack is attached to device 20 on rack support 97 and translating block 78, the bottom edge of the spine and pages of music book B are positioned so that they are resting on platform or ledge 24, and so that the rear surface of book B is leaning against back support section 23. The inner edge of upper rail 34 should also now be slidingly engaged with or resting against the outer surface of spacer 32. In addition, if necessary, the position of binder support top 111, which is part of adjustable book support device 30, may be adjusted either forwardly or rearwardly in relation to back support section 23 and ledge 24 by turning thumb screw 104, wherein if thumb screw 104 is rotated in one direction, binder support top 111 is moved forwardly in relation to back support section 23 and ledge 24, and if the thumb screw 104 is turned in the other direction, binder 111 is moved rearwardly with respect to back support section 23 and ledge 24. The purpose of adjustable book support device 30 is to adjust the width of ledge 24 to compensate for music scores or the like having more or less number of pages and therefore different thicknesses. If the music book B is comprised of a lesser number of sheets and therefore is rather thin, binder support top 110 may be moved forwardly in relation to back support section 23 and ledge 24, essentially also moving music book B forwardly or into closer proximity to page turning rack 28 so that the pages P of book B remain correctly positioned in rack 28. On the other hand, if book B is thicker or has a greater number of pages, binder support top 111 can be moved back to create more space for book B on ledge 24 of book platform 22, again so that pages P of book B remain correctly positioned in page turning rack 28. It should also be evident that repositioning the book support device 30 is accomplished quickly and simply by rotating thumb screw 104 on housing 26, which causes binder support 60 to slide either forwardly or rearwardly in channels 59 of binder support guides 57 and 58. As indicated above, proper positioning of book support device 30 may be important in enabling page turning device to work properly if the device is used with music scores having a substantial range of thicknesses or number of pages. However, although inclusion of such feature as part of the present invention is preferred, and so far as the inventor is aware none of the prior art page turning devices includes such a page support adjustment device, if the thickness of number of pages of the music scores used with the device are within a similar range, which is the usual case, device 20 will also operate correctly if such feature is omitted.

In positioning a music score or book B in rack 28 and on platform 22 so that it is open to the first page, the binding or spine of book B will usually be positioned in close proximity to the left edge of rack 28, and (such as shown in FIG. 11) the first page to be turned p1 will usually be positioned either in front of rod 38*a* and extending across the front of rack 28, or inserted in slot 39*a* formed between rods 38*a* and 38*b* from the rear side of rack 28. In addition, translating block 78, rack support 97, and page turning rack 28 will preferably be initially positioned substantially towards the right side of device 20 as viewed from the front, so that rack 28 can be periodically moved to the left to consecutively turn the pages of book B when desired without being prevented from further movement in such direction by forward left limit switch 66 until all of the pages have been turned.

When the words or music on the first two facing pages to which book B is initially opened have been read or performed, and the user wishes to turn the book B to the next page, such user will press downwardly with his or her foot on forward switch 128 of foot control 126. This will activate motor 90, turning shaft 95 and causing threaded rod 76 to rotate in a direction so that translating block 78 and rack support 97 are moved laterally to the left on rod 76, and as a result, page turning rack 28 will also be moved laterally to the left, with music book or score B remaining in place on book support 22. As rack 28 is moved laterally to the left, the left side or edge of rod 38*a* (or rod 38*b* if the first page is inserted in slot 39*a* rather than in front of rod 38*a*) will begin to push first page p1 to the left, and eventually force page p1 to be turned to the next page. Once rack 28 has been moved just far enough to the left for page p1 to be turned so that the book B is now opened to page p2, forward foot switch 128 is released. If the rack 28 is accidentally moved too far to the left, the user can simply press the reverse switch 129 on foot control 126, which will cause motor 90 to turn in the opposite direction, thereby also turning threaded rod or screw 76 in the opposite direction and causing translating block 78, rack support 97, and attached rack 28 to move laterally to the right rather than to the left. When book B is opened to the correct page, switch 129 is released and the user will continue playing or reading the music score until it is again time to turn to the next page, at which time the steps indicated above are essentially repeated.

Figure 12A:
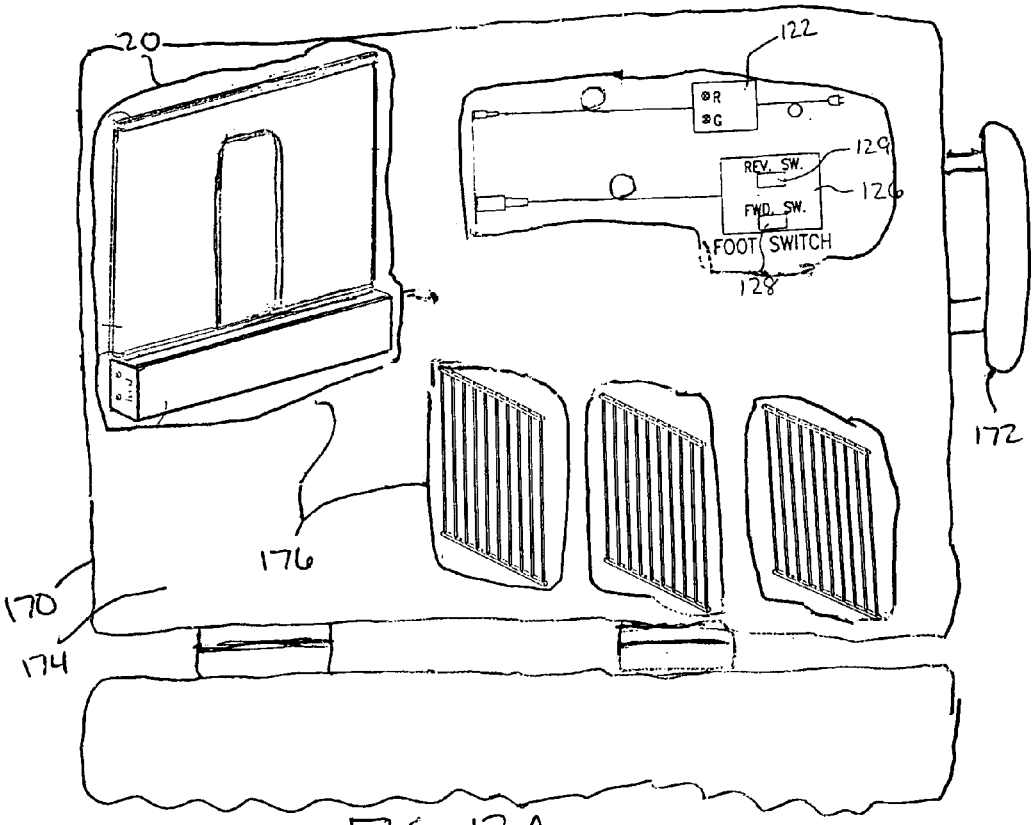
FIG. 12A illustrates diagrammatically the provision of the page turner of the invention in the form of a carrying kit including the page turner device itself, a separate foot control and power cord and a supply of individual racks that can be loaded with separate continuous music scores and used consecutively or otherwise all contained in a convenient carrying case.

In FIG. 12A, there is shown a kit containing one of the page turners 20 of the invention, an appropriate battery charger 122 and foot control 126 for the page turner plus a small supply of racks 28*a*, 28*b*, and 28*c* for use with the page turner in extended or multiple page turning situations. Those parts are shown contained in a carry case similar to a small briefcase 170 with a handle 172 and depressions 174 in the lining 176, the top of the case being shown open and partially broken away.

FIG. 13 is a wiring diagram directed to the embodiment of the invention as described above, with recharger 122 detachably connectable to rechargeable batteries 120, which are operably connected to reversible DC motor 90 via fuse 135 and foot control 126, which, if forward switch 128 is pressed, will cause motor 90 to turn in a forward direction, and if reverse switch 129 is pressed will cause motor 90 to turn in the reverse direction. The operation of motor 90 is also, as explained above, subject to forward limit switch 66 and reverse limit switch 67, which switches will break the circuit and cause motor 90 to immediately turn off if activated.

FIG. 14 illustrates a wiring diagram for an alternative, slightly more preferred embodiment of the page turning device 20. In such arrangement, limit switches 66 and 67 discussed with respect to the previous embodiment have been replaced by forward and reverse photo sensors 142 and 144, respectively. In addition, interrupter flags 146 and 148 have been placed on the bottom side of translating block or follower 78, such that when block 78 is moved to the left far enough so that interrupter flag 146 is in the path of photo sensor 142, or moved far enough to the right so that interrupter flag 148 is in the path of photo sensor 144, such sensors will send a signal to interrupt the circuit and stop motor 90, thereby preventing translating block or follower 78 from moving any further in such direction.

Another feature of the page turning device control system arrangement as described with reference to the wiring diagram in FIG. 14 is the inclusion of a detector in the form of an optical chopper wheel 150, which wheel is of a type well known to those skilled in the art that are used to monitor or count a number of occurrences, and in turn to control the position of translating block or follower 78 on threaded rod or lead screw 76. Optical chopper wheel 150 is electrically connected to a counter 152, which keeps a count of the number of interruptions of a beam of light based on a known interval sensed by such chopper wheel device. Since the exact number of rotations of motor 90, and as a result threaded rod or lead screw 76, required to move translating block or follower 78 and therefore page turning rack 28 either forward or in reverse a sufficient distance to cause a page of a book or music score to be turned and held open, can be calculated, such information may be compared with the number of rotations detected by optical chopper wheel 150 and input to counter 152, so that the control system can be calibrated or programmed to immediately shut off when such number of rotations is reached. In addition, forward and reverse switches 128 and 129 on foot control 126 may now be calibrated or arranged so that when activated, threaded rod or lead screw 76 will rotate exactly such pre-calculated number of rotations or turns and then motor 90 will automatically shut off. As a result, such motor 90 and screw 76 can be rotated or turned at a much faster rate or pace than in the previous embodiment, where the forward or reverse pedal was held down until the page was turned. In other words, in the previous arrangement, the motor could not be turned as fast, since it would be too difficult for the user to control the stopping point of the motor and the page turning device, and the pages would continually be either turned too far or not far enough. The result of the use of optical chopper wheel 150, however, is that each page can be turned much more quickly and with significantly more precision, which will lead to less interruption or distraction to the musician and presumably lead to a better performance. The width of the threads on lead screw 76 also affects the number of rotations of such screw required to move translating block 78 and rack 28 a sufficient distance to turn a single page. If the threads are wider, then fewer rotations of screw 76 would be required, although a slightly more powerful motor may be required to rotate the screw as quickly as is desired. If the threads are closer together, the screw 76 will have to be rotated a greater number of times to turn a single page, although a slightly less or even a significantly less powerful motor may be required. Motor 90 should be as quiet as possible in any event, so that it does not distract a reader or, in the case of a musical performance, cannot be heard, which would negatively affect the quality of the performance. As a result, it may also be desired to provided an insulated cover or the like over such motor to lessen or negate any such motor noise. Another feature of at least one embodiment of the invention is the inclusion of a non-slip surface 180 as part of book or music score support 22. The non-slip surface could take several different forms, such as a sticky or tacky material applied to the surface of back support 22 and/or ledge 24, or a rubber coating on such surfaces. This non-slip surface 180 would be included to ensure that while rack 28 is being used to turn the pages of the music score or book, such music score or book is prevented from sliding or slipping in the same direction along ledge 24 of rack 20, which would cause the page turning device to become misaligned and it would then need to be repositioned or recalibrated to work correctly.

Referring still to FIG. 14, transistor switch 154 is electrically connected to motor 90, which is powered by rechargeable battery pack 120. A low battery LED indicator light 156 is also provided to monitor the status of battery pack 120, and in addition a mode LED indicator light 158 is provided to monitor or signal the mode of operation of such control assembly. When external foot pedal or switch 126 is pressed to move the page turning rack 28 in either a forward or reverse direction, such mode is detected and an electrical signal is sent to reversible DC motor 90, which is immediately activated long enough to turn rod 76 in either a forward or reverse direction and move translating block or follower 78 and rack 28 a sufficient distance to turn a music score page. In addition, power is supplied to photo sensors 142 and 144 to detect if translating block or follower 78 has been moved too far in either direction, where such sensors will be interrupted by either flag 146 or 148. As indicated above, such arrangement enables the page turner rack 28 to be moved more quickly and with more precision than is possible in prior art page turning devices. A means for automatically calibrating the system after it has been turned on and the loaded page turning rack has been mounted thereon may also be provided to improve the operating efficiency of such system.

The short or close together threads of the rotatable threaded rod shown in FIG. 14 plus the use of the chopper wheel or other equivalent rotational movement detecting and monitoring apparatus enable the musician to merely tap the foot pedal of the apparatus to start a page turning cycle. The cycle will then continue until the threaded rod has turned sufficiently to turn the page and stop until the foot pedal is again operated. The page turning operation itself thus has minimum distraction for the musician. It is desirable for the movement of the screw threaded rod to begin its movement cycle at a somewhat lesser speed at the beginning of a page turning cycle and to similarly slow down at the conclusion of such cycle before stopping. This has been found to enhance smoothness of operation and facilitate even faster movement during the central section of the cycle.

In an improvement of the page turning rack 190 shown in FIG. 15, three is shown an upper rail 191, a lower rail 192, and a series of individual page turning bars 193. The bottoms of the individual page turning bars 193 can be pivoted with respect to lower rail 192 in any convenient manner such as having a bulbular or ball and socket construction 194, with the ball member connected to the lower end of page turning bars 193, and the socket being an orifice in lower rail 192. The top ends of the bars 193 can be held in a restricted sized slot or groove 195 in top rail 191 having a narrow entrance through which the top of the rod can be forced and then held, or any other clip arrangement can be used. When it is desired to place the rack over the pages of a musical score or the like, the score can be placed on a flat surface and the rack placed on top with the rods turned down. The individual pages can then be turned up one by one and the individual rods pivoted up and snapped into the top portion of the rack one by one behind such page before placing the score and the rack in position on top of the page turner.

As will be recognized from the foregoing description, the page turner of the invention constitutes a significant improvement of previous page turners which can be used in many varied situations both by professional musicians as well as less experienced musicians and even students of music who must play longer compositions in recitals and the like. The apparatus of the invention enables the musician to place his or her entire attention upon the compositions to be played and such musician is therefore enabled to better perform rather than having his or her attention distracted by having to pay attention to manually changing the pages of music or musical score, which chore relatively inexperienced musicians can find interrupts badly the rendition of musical virtuosity. It should also be noted that the device can be provided either as an additional to an existing music stand such as one having tripod-type legs or attached to a conventional piano, wherein the device is placed on such stand and then the music score inserted in the rack, or, alternatively, the page turning device may be provided already integrated into said music stand or instrument, thereby omitting the need to be placed or supported on an existing stand.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A page turner for volumes having multiple pages secured together at one side comprising:

(a) a base, (b) an upward extension from said base, (c) a rotatable spirally grooved rod supported in the base, (d) motive means for rotating said spirally grooved rod, (e) a carriage movable along the base in operative engagement with said spirally grooved rod, (f) guide means at the upper end of the upward extension, (g) a page engaging rack engageable with the carriage at its lower end and the guide means at its upper end, and (h) a support for a rear connected together side of a multiple page volume with at least some of its pages engaged with the rack, said support being movable front and back transversely with respect to the base to provide adjustment for the thickness of the connected together pages of a volume.

2. A page turner in accordance with claim 1 wherein the rack has longitudinal top and bottom members connected by elongated curvilinear page turning members between which discrete pages of a volume to be referred to and turned are interposed plus engagement means for the carriage, said rack being removable from the page turner and replaceable.

3. A page turner in accordance with claim 2 wherein there are provided multiple racks which can be mounted upon the page turner consecutively with the page turning members already engaged between the pages of a volume.

4. A page turner in accordance with claim 3 wherein the bottom member of the rack travels between extended guide means above the movable carriage in the form of two guide pieces forming a track between which the lower end of the rack travels.

5. A page turner in accordance with claim 4 additionally comprising:

(i) motor control means having a switch for activating the motor means by manual activation, and (j) an associated automatic timing arrangement whereby upon activation of the motor control switch the motor follows a preset pattern of operation.

6. A page turner in accordance with claim 5 wherein the pattern of operation is to move said page turning rack a known distance to turn a page either forward or backward into a position for reading.

7. A page turner in accordance with claim 6 wherein the pattern of operation is repeating each time the switch means is operated.

8. A page turner in accordance with claim 7 wherein the pattern of operation can be preset to the satisfaction of the operator.

9. A page turner in accordance with claim 8 wherein the page turning rack is engaged with the carriage by easily engaged and disengaged detents.

10. A page turner in accordance with claim 9 wherein the detents are curvilinear extensions engageable with similar shaped openings in the carriage.

11. A page turner in accordance with claim 10 wherein the detents are substantially circular pegs.

12. A page turner in accordance with claim 11 wherein the curvilinear page turning markers are at least partially cylindrical.

13. A music score page turning device comprising:

a music score support;

a threaded rod secured in a housing connected to the lower end of the music score support;

a reversible motor means operably connected to the threaded rod;

a rack support connected to said threaded rod so as to be capable of moving laterally in said housing along the front of the music score support as said rod rotates; and a rack detachably connected to said rack support, said rack comprised of a pair of rails fixed to opposite ends of a plurality of spaced apart ribs and adapted to receive the pages of a music score between said ribs and to turn said pages consecutively on when connected to the page turner device.

14. The page turning device of claim 13 wherein said music score support is comprised of a back support section and a ledge section, and additionally comprising an adjustable support binder that is movable in a longitudinal direction on said device with respect to the ledge section in an aperture in the middle area of the back support section for varying the usable width of said ledge section depending upon the thickness of a music score.

15. The music score page turning device of claim 13 wherein said rack support is slidable on a longitudinal rail.

16. The music score page turning device of claim 14 additionally comprising a foot pedal for controlling activation of said motor means.

17. The music score page turning device of claim 14 additionally comprising a limit means for signaling when the rack support has traveled a maximum distance in either a forward or reverse direction and upon reaching said limit turning off the power to said motor.

18. The music score page turning device of claim 17 wherein said limit means is comprised of a pair of photosensors.

19. The music score page turning device of claim 13 additionally comprising a means for keeping track of the number of rotations of the threaded rod and as a result the position of the rack support movable on the threaded rod, whereby the turning device may be programmed to activate the motor means and move the page turning rack, as a result of pressing said foot pedal, a distance sufficient to turn the page of a music score properly to the next or previous page and then automatically shut off.

20. The music score page turning device of claim 19 wherein said device is battery powered.

* * * * *